United States Patent [19]

Nicol et al.

[11] 3,962,152

[45] June 8, 1976

[54] DETERGENT COMPOSITIONS HAVING IMPROVED SOIL RELEASE PROPERTIES

[75] Inventors: Charles Henry Nicol, Hamilton; Hugh Robert Hays, Harrison, both of Ohio

[73] Assignee: The Procter & Gamble Company, Cincinnati, Ohio

[22] Filed: June 25, 1974

[21] Appl. No.: 483,185

[52] U.S. Cl. ..... 252/551; 252/8.6; 252/8.9; 252/DIG. 2; 428/265

[51] Int. Cl.[2] ..... C11D 7/26

[58] Field of Search ..... 252/551, 8.6, 8.9, DIG. 15, 252/DIG. 2; 260/29.2 E; 428/265

[56] References Cited

UNITED STATES PATENTS 3,712,873 1/1973 Zenk ..... 252/8.9

3,798,169 3/1974 Dickson et al. ..... 252/8.6

FOREIGN PATENTS OR APPLICATIONS 1,154,730 6/1969 United Kingdom ..... 252/DIG. 15

*Primary Examiner*—William E. Schulz

*Attorney, Agent, or Firm*—Jerry J. Yetter; Richard C. Witte; Charles R. Wilson

[57] ABSTRACT

Detergent compositions containing surface-active agents and soil release polymers comprising ethylene terephthalate and polyethylene oxide terephthalate provide improved cleaning and impart a soil release finish to synthetic fabrics treated therewith.

8 Claims, No Drawings

DETERGENT COMPOSITIONS HAVING IMPROVED SOIL RELEASE PROPERTIES

BACKGROUND OF THE INVENTION

This invention encompasses solid detergent compositions comprising a surface-active agent selected from the group consisting of anionic, nonionic, zwitterionic, and ampholytic surfactants, and mixtures thereof, and a paticular type of soil release polymer comprising ethylene terephthalate and polyethylene oxide terephthalate in particular ratios and proportions. The detergent compositions herein clean and provide improved soil release benefits to synthetic fabrics, particularly polyester fabrics, as compared with known soil release agents employed in detergent compositions.

Much effort has been expended in designing various compounds capable of conferring soil release properties to fabrics woven from polyester fibers. These fabrics are mostly co-polymers of ethylene glycol and terephthalic acid, and are sold under a number of tradenames, e.g., Dacron, Fortrel, Kodel and Blue C Polyester. The hydrophobic character of polyester fabrics makes their laundering (particularly as regards oily soil and oil stains) difficult, principally due to the inherently low wettability of the polyester fibers. Since the character of the fiber itself is hydrophobic, or oleophilic, once an oily soil or oily stain is deposited on the fabric it tends to be "attached" to the surface of the fiber. As a result, the oily soil or stain is difficult to remove in an aqueous laundering process.

When hydrophilic fabrics such as cotton are soiled by oily stains or oily soil, it is well-recognized that the oil is much more easily removed than in the case of hydrophobic polyester fabrics. This difference in oil removal characteristics is apparently caused by a greater affinity of cotton fabrics for water. The differing hydrophilic/hydrophobic characteristics of cotton and polyester are due in part to the basic building blocks of the fibers themselves. That is, since polyester fibers are copolymers of terephthalic acid and ethylene glycol, they have less affinity for water because there are fewer free hydrophilic groups, e.g., hydroxyl or carboxyl groups, where hydrogen bonding can occur. With cotton, which is a cellulose material, the large number of hydrophilic groups provides compatibility with, and affinity for, water.

From a detergency standpoint, the most important difference between hydrophobic fabrics and hydrophilic fabrics is the tendency for oily soil to form easily removable droplets when present on a hydrophilic fabric and in contact with water. The mechanical action of washing and the action of synthetic detergents and builders normally used in the washing step of the laundering process removes such oil droplets from the fabric. This droplet formation is in contrast to the situation which exists with a polyester (hydrophobic) fiber. Water does not "wick" well through hydrophobic fabrics and the oily soil or stain tends to be retained throughout the fabric, both because of the inherent hydrophobic character of the fabric and the lack of affinity of oily soils for water.

Since polyester and polyester-blend fabrics (e.g., polyester-cotton blends) are susceptible to oily staining, and, once stained, are difficult to clean in an aqueous laundry bath, manufacturers of polyester fibers and fabrics have sought to increase the hydrophilic character of the polyester to provide ease of laundering.

A number of approaches to the problem of increasing the hydrophilic character of polyester fabrics and fabric blends have been taken. Many of these approaches involve a process employed by the textile/fiber manufacturer or the textile manufacturer. Netherlands Application 65/09456 [see also D. A. Garrett and P. N. Hartley, *J. Soc. Dyers and Colourists*, 82, 7, 252–7 (1967) and *Chem. Eng. News*, 44, 42–43 (Oct. 17, 1966)] describes the treatment of polyester fabrics in which a copolymer of terephthalic acid with a polyethylene glycol is padded onto the polyester fiber using an emulsion containing a 20% concentration of the padding agent, a polyester swelling agent such a benzyl alcohol, and heat. The object of this treatment is to give the basic polyester fiber more hydrophilic character, thereby reducing the tendency of the polyester fiber to retain oily stains.

Different polyester fabric finishing techniques are, for example, described in: German Pat. No. 1,194,363; Netherlands Application 65/02428; Belgium Pat. No. 641,882; and French Pat. No. 1,394,401.

British Pat. No. 1,088,984 relates to a modifying treatment for polyester fibers whereby a polyethylene terephthalate polymer is applied to the surface of said fibers. The polymers employed contain ethylene terephthalate and polyethylene oxide terephthalate units at a molar ratio from 1:1 to 8:1. The polyethylene oxide used for preparing these polymers has a molecular weight in the range of 300 to 6,000, preferably from 1,000 to 4,000.

British Pat. No. 1,175,207 discloses a process for treating filaments and fibers by contacting same with polyesters containing from about 10 to about 50% by weight of crystalline polyester segments which are identical with the repeat units forming the crystalline segment of the polyester fiber, and from about 50 to about 90% by weight of water solvatable polyoxyalkylene ester segments. The polymers employed appear to be identical to those disclosed in British Pat. No. 1,088,984.

British Pat. No. 1,092,435 deals with a stable dispersion of water-insoluble graft polymers containing polyoxyethylene glycol and polyethylene terephthalate. These polymers have a ratio of ethylene terephthalate to polyoxyethylene terephthalate from about 2:1 to about 6:1. Also, the teachings of British Pat. No. 1,119,367, and Dutch Pat. No. Application 66/14134, relate to the application to fibers of surface modifying agents as described in the patents referred to hereinabove.

U.S. Pat. No. 3,712,873, Zenk, discloses the use of polyester polymers in combination with quaternary ammonium salts as fabric treatment compositions. Terpolymers having a molecular weight in the range from 1,000 to 100,000, and a molar ratio of terephthalic acid:polyglycol:glycol from 4.5:3.5:1 are disclosed. Co-pending application U.S. Ser. Number 328,824, filed Feb. 1, 1973, Bassadur, now U.S. Pat. No. 3,893,929, relates to compositions and processes for imparting renewable soil release finish to polyester-containing fabrics. Polyesters based on terephthalic acid, ethylene glycol and polyethylene oxide, and their use in acidic fabric rinses, are disclosed. The polymers have a molecular weight in the range from 1,000 to 100,000, and the polyethylene oxide link has a molecular weight of 1300 to 1800.

The concurrently filed U.S. patent application Serial Number 482,948, inventor, Charles H. Nicol, entitled LIQUID DETERGENT COMPOSITIONS HAVING SOIL RELEASE PROPERTIES, discloses compositions comprising nonionic surfactants, ethanolamine-neutralized anionic surfactants, free ethanolamine and a soil-release polymer which can be identical to the novel polymers employed herein.

The prior art polymers do not provide an optimum solution to the soil release problem inherent with any hydrophobic fiber mainly because of lack of durability and marginal-to-unsatisfactory soil release performance. Moreover, many of the prior art soil release polymers lack the necessary substantivity to fibers under conditions of neutral-to-alkaline pH, i.e., under common laundering conditions. In addition, some of the known polymers seem to require calcium ions for fiber substantivity. Of course, the presence of free calcium or other water hardness cations is preferably avoided in a laundering operation.

It has now been found that certain hydrophilic terephthalate-based polymers having critical ratios of monomer units as well as critical limitations on the molecular weight of the hydrophilic moieties in the polymers are particularly useful as soil release agents. The in-use superiority of the polymers herein over those of the prior art is surprising in that nothing in the vast literature in this area suggests that the critical polymer design now provided would have any substantial effect on soil release properties. Moreover, the present compositions are provided in solid granular or powder form and are not limited to the liquid compositions of Nicol, above. This desirable result is made possible by using the polymers disclosed by Hays, below.

The concurrently filed U.S. patent application Ser. No. 482,949, inventor Hugh R. Hays, entitled POLYETHYLENE OXIDE TEREPHTHALATE POLYMERS, the disclosures of which are incorporated herein by reference, describes novel terephthalate polymers composed of ethylene terephthalate and polyethylene oxide terephthalate. Such polymers are capable of imparting soil release properties to synthetic fibers in a dilute aqueous solution. These novel polymers are identical to those now found to be useful in dry granular or powdered detergent compositions.

It is an object of this invention to provide solid detergent compositions capable of simultaneously cleaning and imparting soil release properties to synthetic fibers laundered therewith.

It is an additional object of this invention to provide detergent compositions in solid form capable of conferring effective soil release properties to fabrics, said compositions comprising an organic surface-active agent and a polymer composed of ethylene terephthalate and polyethylene oxide terephthalate, as disclosed hereinafter. The chief advantage of solid detergents over the liquid form is that substantial proportions of detergency builders can be conveniently used in solid compositions of the type disclosed herein.

These and other objects are obtained herein as will be seen from the following disclosures.

SUMMARY OF THE INVENTION

The present invention encompasses solid detergent compositions capable of simultaneously cleaning and imparting improved soil release characteristics to fabrics, especially hydrophobic fabrics such as polyesters. The compositions herein comprise:

a. from about 2 to about 95% by weight of a member selected from the group consisting of water-soluble anionic, nonionic, zwitterionic and ampholytic surface-active agents and mixtures thereof; and b. from about 0.05 to about 25% by weight of a soil release polymer, said polymer comprising ethylene terephthalate and polyethylene oxide terephthalate at a molar ratio of ethylene terephthalate to polyethylene oxide terephthalate of from about 25:75 to about 35:65, said polyethylene oxide terephthalate containing polyethylene oxide having a molecular weight of from about 300 to 700, the overall molecular weight of the soil release polymer being in the range of from about 25,000 to about 55,000.

The compositions herein can also contain various optional adjunct materials commonly employed in detergent compositions.

DETAILED DESCRIPTION OF THE INVENTION

The detergent compositions of the instant invention comprise: (1) a surface-active agent; and (2) a specific type of polymer. These components are described in detail hereinafter.

Unless stated to the contrary, the term "%" as used herein indicates percent-by-weight.

Surface-Active Component

The surface-active agent is used in a detersive amount, i.e., an amount of from about 2 to about 95%, preferably from about 5 to about 30%, of the compositions herein. Since the soil release polymers herein are substantially electrically neutral polyesters, they are compatible with all manner of detersive surface-active agents. In fact, any of the well-known surface-active agents are useful herein. A list of typical surface-active detergents useful herein appears in U.S. Pat. No. 3,719,647 and 3,707,504, incorporated by reference.

Examples of suitable surface-active agents useful herein include the group consisting of anionic, nonionic, ampholytic and zwitterionic detergents and mixtures thereof.

Preferred surfactants herein include the alkali metal alkyl benzene sulfonates in which the alkyl group contains from about 9 to about 20 carbon atoms in straight chain or branched-chain configuration, e.g., those of the type described in U.S. Pat. Nos. 2,220,099 and 2,477,383 (especially valuable are linear straight chain alkyl benzene sulfonates in which the average of the alkyl groups is about 11.8 carbon atoms and commonly abbreviated as $C_{11.8}$LAS).

Another preferred surfactant type useful herein encompasses alkyl ether sulfates. These materials have the formula $RO(C_2H_4O,)_xSO_3M$ wherein R is alkyl or alkenyl of about 10 to about 20 carbon atoms, $x$ is 1 to 30, and M is a watersoluble cation such as alkali metal, ammonium and substituted ammonium. The alkyl ether sulfates useful in the present invention are condensation products of ethylene oxide and monohydric alcohols having about 10 to about 20 carbon atoms. Preferably, R has 14 to 18 carbon atoms. The alcohols can be derived from fats, e.g., coconut oil or tallow, or can be synthetic. Lauryl alcohol and straight chain alcohols derived from tallow are preferred herein. Such alcohols are reacted with 1 to 30, and especially 1 to 6, molar proportions of ethylene oxide and the resulting mixture of molecular species, having, for example, an average of 3 moles of ethylene oxide per mole of alcohol, is sulfated and neutralized.

Specific examples of alkyl ether sulfates useful herein are sodium coconut alkyl ethylene glycol ether sulfate; sodium tallow alkyl triethylene glycol ether sulfate; and sodium tallow alkyl hexaoxyethylene sulfate.

Other preferred surfactants herein are the olefin sulfonates having about 12 to about 24 carbon atoms. The term "olefin sulfonates" is used herein to mean compounds which can be produced by the sulfonation of $\alpha$-olefins by means of uncomplexed sulfur trioxide, followed by neutralization of the acid reaction mixture in conditions such that any sultones which have been formed in the reaction are hydrolyzed to give the corresponding hydroxy-alkane-sulfonates. The sulfur trioxide can be liquid or gaseous, and is usually, but not necessarily, diluted by inert diluents, for example, by liquid $SO_2$, chlorinated hydrocarbons, etc., when used in the liquid form, or by air, nitrogen, gaseous $So_2$, etc., when used in the gaseous form.

The $\alpha$-olefins from which the olefin sulfonates are derived are mono-olefins having 12 to 24 carbon atoms, preferably 14 to 16 carbon atoms. Preferably, they are straight chain olefins. Examples of suitable 1-olefins include 1-dodecene; 1-tetradecene; 1-hexadecene; 1-octadecene; 1-eicosene and 1-tetracosene.

In addition to true alkene sulfonates and a portion of hydroxy-alkanesulfonates, olefin sulfonates can contain minor amounts of other materials, such as alkene disulfonates depending upon the reaction conditions, reactant ratios, the nature of the starting olefins and impurities in the olefin stock and side reactions during the sulfonation process.

Specific $\alpha$-olefin sulfonates for use in the present invention are described more fully in U.S. Pat. No. 3,332,880 of Phillip F. Pflaumer and Adriaan Kessler, issued July 25, 1967, titled DETERGENT COMPOSITION, the disclosures of which are incorporated herein by reference.

Soil Release Polymer

The soil release polymers are used herein in an amount from about 0.05 to 25%, preferably from about 0.2 to about 10%, and most preferably from 0.5 to 5%, by weight of the total compositions.

The soil release polymer component herein contains ethylene terephthalate groups having the formula

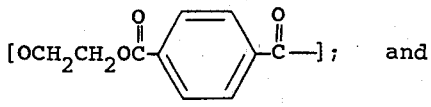

and polyethylene oxide terephthalate groups having the formula

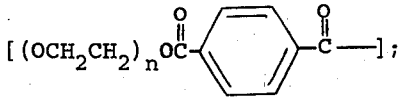

the molar ratio of ethylene terephthalate to polyethylene oxide terephthalate being from about 25:75 to about 35:65, preferably about 30:70. In the formula, n is an integer from about 7 to about 16, i.e., the molecular weight of the polyethylene oxide linking unit is in the range from about 300 to about 700, preferably from about 500 to about 650. The polymers herein have a molecular weight in the range from about 25,000 to about 55,000, preferably from about 40,000 to about 55,000. The polymers are also characterized by a random structure, i.e., due to the method of preparation, all possible combinations of ethylene terephthalate and polyethylene oxide terephthalate are present.

The preferred polymers of this invention are prepared by using only those molar ratios of precursor materials which provide the critical ratios of ethylene terephthalate: polyethylene oxide terephthalate set forth above. These precursors are polymerized in the manner described hereinafter. For example, a highly preferred polymer herein is prepared from, and accordingly comprises, a mole ratio of terephthalic acid:ethylene glycol-polyethylene oxide of about 1.0:0.3:0.7. Additionally, the preferred polymers of this invention have a melting point below about 100°C.

The instant polymers are substantive to hydrophobic fabrics, particularly polyester, under conditions of varying pH, particularly under the conditions of neutral to alkaline pH which occur during conventional fabric laundering operations. It is known that many prior art soil release polymers tend to become relatively less substantive to hydrophobic fabrics when applied under conditions of neutral-to-alkaline pH. Apparently, this pH substantivity relationship is due to the presence of free carboxylic acid groups in many of the prior art agents. Partial hydrolysis of such prior art materials seems to be a prerequisite to optimal performance. Moreover, the instant polymers are substantive to fibers even under conditions involving low levels of calcium ions, such as obtain with built detergent systems. The deficiency of known polymers in this respect is related to their inefficiency in becoming affixed to polyester fibers in soft or low hardness water.

Polymer Preparation

The polymerization process used herein is an esterification reaction similar to those known in the art. However, the concentrations and ratios of polymer precursors used in the process must be fixed so as to meet the compositional requirements of the instant polymers. More specifically, the polymers herein are prepared in the manner of Hays, above. The polymers of this invention can be prepared according to the process described in the specification of British Pat. No. 1,119,367, modified in the manner of Hays, as follows.

194 g. dimethyl terephthalate, 67 g. ethylene glycol, 420 g. polyethylene oxide (molecular weight 600), 0.44 g. 2,6-di-tert-butyl-4-methylphenol, 0.0776 g. antimony trioxide, and 0.3024 g. calcium acetate are mixed in a suitable reaction vessel and heated to 210°C with stirring over a 1.5 hour period. During this time, methanol and some dimethyl terephthalate are distilled from the reaction vessel. The reaction temperature is then raised to 280°C and held there for 2 hours. Following addition of 0.282 g. of a 24.8% solution of phosphorous acid in ethylene glycol, a stream of nitrogen is blown over the reaction and allowed to exhaust for two hours. Dispersions of the polymer so formed are made by mixing the molten polymer with water in a Waring blender.

It should be noted that in the preparation of the preferred polymers herein the nitrogen exhaustion preferably lasts from about 2 hours to about 2.5 hours. Lowering the nitrogen exhaustion to about 1.5 hours or increasing it to about 3.0 hours adversely affects the soil-release characteristics of the polymers.

Optional Ingredients

The compositions of the present invention desirably contain, as an optional ingredient, a water-soluble detergency builder component. Detergency builders are used at concentrations of from about 0 to about 70%, preferably 20 to 70% by weight of the total detergent composition. As in the case of the surface-active agents, all manner of well-known detergency builders are compatible with the polymers herein and are suitable for use in the present detergent compositions. Such detergency builders serve to maintain the pH of laundry solutions containing the present compositions in the range of from about 7 to about 12, preferably from about 8 to about 11. Builders also enhance fabric cleaning performance, suspend particulate soils released from the surface of the fabric, etc.

Builders useful herein can be of the poly-valent inorganic and poly-valent organic types, or mixtures thereof. Non-limiting examples of suitable water-soluble, inorganic alkaline detergent builder salts include the alkali metal carbonates, borates, phosphates, polyphosphates, tripolyphosphates, bicarbonates, silicates and sulfates. Specific examples of such salts include the sodium and potassium tetraborates, perborates, bicarbonates, carbonates, tripolyphosphates, orthophosphates and hexametaphosphates.

Examples of suitable organic alkaline detergency builder salts are (1) water-soluble amino polyacetates, e.g., sodium and potassium ethylenediamine tetraacetates, nitrilotriacetates and N-(2-hydroxyethyl)nitrilodiacetates; (2) water-soluble salts of phytic acid, e.g., sodium and potassium phytates; (3) water-soluble polyphosphonates, including sodium, potassium and lithium salts of ethane-1-hydroxy-1,1-diphosphonic acid; sodium, potassium and lithium salts of methylenediphosphonic acid and the like.

Additional organic builder salts useful herein include the polycarboxylate materials described in U.S. Pat. No. 2,264,103, including the water-soluble alkali metal salts of mellitic acid. The water-soluble salts of polycarboxylate polymers and copolymers such as are described in U.S. Pat. No. 3,308,067, incorporated herein by reference, are also suitable herein. It is to be understood that while the alkali metal salts of the foregoing inorganic and organic poly-valent anionic builder salts are preferred for use herein from an economic standpoint, the ammonium, alkanolammonium, e.g., triethanolammonium, diethanolammonium, and the like, watersoluble salts of any of the foregoing builder anions are also useful herein.

Mixtures of organic and/or inorganic builders can be used herein. One such mixture of builders is disclosed in Canadian Pat. No. 755,038, e.g., a ternary mixture of sodium tripolyphosphate, trisodium nitrilotriacetate and trisodium ethane-1-hydroxy-1,1-diphosphonate.

While any of the foregoing alkaline poly-valent builder materials are useful herein, sodium tripolyphosphate, sodium nitrilotriacetate, sodium mellitate, sodium citrate, sodium oxydisuccinate and sodium carbonate are preferred herein for this builder use.

In addition to the ingredients described hereinbefore, the detergent compositions of this invention can also contain from about 0.5 to about 40% of other optional ingredients which make the product more effective and more attractive.

For example, organic and inorganic peroxy bleach compounds can be incorporated in the composition in an amount from about 5 to about 40%.

The peroxy bleach compound can be represented by all usual inorganic and organic ingredients which are known to be satisfactory for use in detergent compositions. Examples of inorganic peroxy bleach compounds are the alkali metal salts of perborates, percarbonates, persilicates, persulfates, and perphosphates. As is well known, the perborates can have different degrees of hydration. Although frequently the tetrahydrate form is used, it is often desirable to employ the perborates having a lower degree of hydration, for example, one mole, two moles, or three moles of water. Organic peroxy bleach agents can be used as well. Sodium perborate is especially useful herein.

Specific examples of the organic peroxy-bleach compounds are the water-soluble salts of mono- and diperoxy acids such as perazelaic acid, monoperoxyphthalic acid, diperoxy-terephthalic acid, 4-chlorodiperoxyphthalic acid. Preferred aromatic peracids include the water-soluble salts of diperisophthalic acid, m-chloroperbenzoic acid and p-nitroperbenzoic acid.

In the event the peroxy bleach compound is to be prepared in situ, then its precursors, i.e., a peroxy bleach agent and a peroxygen activator are added separately to the detergent compositon. The peroxy bleach can be represented by all oxygen bleaching agents which are commonly used in detergent technology, i.e., organic and inorganic species, as mentioned hereinbefore. The activating agents can be represented by all oxygen activators known as being suitable for use in detergent technology. Specific examples of the preferred activators include acylated glycoluriles, tetraacetyl methylene diamine, tetraacetyl ethylene diamine, triacetyl isocyanurate and benzoylimidazole. Acid anhydride activators which bear at least one double bond between carbon atoms $\alpha,\alpha'$ to the carbonyl group of the anhydride radical can be used as well. Examples thereof are phthalic and maleic anhydrides. Especially preferred bleach activators are based on aldehydes, ketones, and bisulfite adducts of aldehydes and ketones. Examples of these especially preferred activators include: 1,4-cyclohexanedione; cyclohexanone; 3-oxocyclohexylacetic acid; 4-tertbutylcyclohexanone; 5-diethylmethylammonio-2-pentanone nitrate; N-methylmorpholinioacetophenone nitrate; acetone; methyl ethyl ketone; 3-pentanone; methyl-pyruvate; N-methyl-4-oxo-piperidine oxide; 1,4-bis(N-methyl-4-oxopiperidiniomethyl)benzene chloride; N-methyltropinonium nitrate; 1-methyl-4-oxo-tetrahydrothiopyranonium nitrate; N-benzyl; N-methyl-4-oxopiperidinium nitrate; N,N-dimethyl-4-oxo-piperidinium nitrate; di-2-pyridylketone; and chloral hydrate.

In the event the per-bleach is prepared in situ, then the molar ratio of peroxygen bleach agent to bleach activator is preferably in the range from about 5:1 to 1:2, especially from 2:1 to 1:1.2.

Other detergent composition ingredients used herein include suds regulating agents such as suds boosters and suds suppressing agents, tarnish inhibitors, soil suspending agents, buffering agents, brighteners, fluorescers, perfumes, dyes, inert carriers and mixtures thereof. The suds boosters can be the well-known diethanolamides. Silicones and hydrophobic alkylene oxide condensates can be used in the compositions for suds suppressing purposes or, more generally, for suds regulating purposes. Benzotriazole and ethylenethiourea can be used as tarnish inhibitors. Carboxymethyl cellulose is a well-known soil suspending agent. The above additional ingredients are employed in the usual concentration ranges, commonly 0.1 to about 1.5% of the total composition.

The detergent compositions of the instant invention are in a substantially dry state, and can be prepared as dry powders, dry powder admixes or spray-dried granules in the manner well known in the detergency arts.

The following examples are illustrative of this invention, but are not intended to be limiting thereof.

EXAMPLE I

A granular detergent composition useful for evaluating the in-use detergency performance of the polymers herein is as follows. The composition is typical of commercial, built detergents.

| Ingredients | Parts by Weight |
|---|---|
| Sodium linear dodecylbenzene sulfonate | 7.5 |
| Sodium tallow alkylsulfate | 9.2 |
| Condensation product of coconut alcohol with 6 moles of ethylene oxide | 1 |
| Sodium tripolyphosphate | 49.5 |
| Sodium silicate solids (ratio $SiO_2/NaO=2.0$) | 5.5 |
| Sodium sulfate | 13.5 |
| Moisture and minor ingredients | Balance to 100 |

The foregoing composition was used to evaluate the soil removal capabilities of the instant polymers on hydrophobic textiles. The tests were of two types. In the first, the clean test fabric was laundered in an aqueous bath containing the above composition and either 50 ppm or 100 ppm of the soil release polymer being tested. In this "pre-wash" procedure, the polymer was established on the fabric surface prior to staining. In the second test, the fabric was stained prior to washing with the polymercontaining detergent. The "no pretreatment" test results reflect the unexpectedly improved cleaning performance obtained with the polymers herein, whereas the "one pretreatment" results demonstrate their superior soil release properties.

Desized 4 inch square polyester swatches, either pre-washed with the compositions of this invention or untreated, were soiled by spotting 0.01 ml. of various types of oily soils in the center of the swatch. The soiled swatches were allowed to wick for 18 hours at ambient conditions. Thereafter, soiled and reference swatches were laundered in an automatic miniature washer. Stain removal was determined gravimetrically by comparing the weight of the soiled swatch before and after laundering. Other testing parameters were: washing temperature – 105°F; water hardness — 7 grains/U.S. gallon; washing time — 10 minutes; detergent concentration — 0.12% by weight; and soil — as indicated.

TABLE I

| Soil | PPM Polymer in Bath | Molar Ratio Ethylene Terephthalate to Polyethyleneoxide Terephthalate | Molecular Weight Polyethylene Oxide | % Soil Removal |
|---|---|---|---|---|
| | | One Pretreatment TERPOLYMER | | |
| Crisco Oil | 0 | Reference Swatch | | 17 (avg. 2 tests) |
| Crisco Oil | 50 | 70:30 | 1540 | 61.5 (avg. 2 tests) |
| Crisco Oil | 50 | 30:70 | 600 | 85 (avg. 2 tests) |
| Bacon Grease | 0 | Reference Swatch | | 28 |
| Bacon Grease | 100 | 30:70 | 600 | 49 |
| Bacon Grease | 50 | 30:70 | 600 | 61 |
| Crisco Oil | 0 | Reference Swatch | | 17 |
| Crisco Oil | 100 | 30:70 | 600 | 83 |
| Dirty Motor Oil | 0 | Reference Swatch | | 27 |
| Dirty Motor Oil | 100 | 70:30 | 1540 | 10 |
| Dirty Motor Oil | 100 | 30:70 | 600 | 78 |
| | | No Pretreatment | | |
| Crisco Oil | 0 | Reference Swatch | | 17 |
| Crisco Oil | 100 | 70:30 | 1540 | 40 |
| Crisco Oil | 100 | 30:70 | 600 | 69 |

The foregoing clearly demonstrates that the polymers of the instant invention provide superior soil release properties over superficially similar prior art polymers formulated with opposite ratios of ethylene terephthalate and polyethylene oxide terephthalate, using high molecular weight polyethylene oxide. The test results also demonstrate the improved cleaning performance of the compositions herein.

A granular detergent composition was prepared having the following formula:

EXAMPLE II

| Ingredients | Parts by Weight |
|---|---|
| Sodium linear dodecylbenzene sulfonate | 14.5 |
| Sodium tripolyphosphate | 49.6 |
| Sodium silicate solids (ratio $SiO_2/Na_2O=2$) | 5.9 |
| Sodium sulfate | 14.9 |
| Moisture and minor ingredients | Balance to 100 |

In The above composition was used to evaluate the soil release properties and cleaning performance of the polymers herein by a visual grading technique. Visual grades were assigned to polyester test swatches using a grading scale from 0 to 5, whereby 0 represents no removal and 5 represents complete removal. The results shown represent the average ratings of, at least, two expert judges.

In the tests the swatches were prewashed prior to soiling in an aqueous solution of the above composition and 250 ppm of the soil release polymer. The washing temperature was 125°F and the water hardness was 7 grains/U.S. gallon. Results are set forth in Table II.

TABLE II

| Soil | PPM Polymer in Bath | TERPOLYMER Molar Ratio Ethylene Terephthalate to Polyethyleneoxide Terephthalate | Molecular Weight Polyethylene Oxide | Score |
|---|---|---|---|---|
| Dirty Motor Oil | 0 | Reference Swatch | | 0 |
| Dirty Motor Oil | 250 | 30:70 | 600 | 5 |
| Bacon grease | 0 | Reference Swatch | | 2.6 |
| Bacon grease | 250 | 30:70 | 600 | 5 |
| Mineral Oil | 0 | Reference Swatch | | 2.2 |
| Mineral Oil | 250 | 30:70 | 600 | 5 |
| Margarine | 0 | Reference Swatch | | 2.3 |
| Margarine | 250 | 30:70 | 600 | 5 |

In the foregoing tests, comparable soil release and cleaning performance are also obtained when the polymer (molar ratio ethylene terephthalate to polyethylene oxide terephthalate 30:70; MW polyethylene oxide 600) is successively replaced by polymers having molar ratios of ethylene terephthalate to polyethylene oxide terephthalate of 25:75; 28:72; 31:69; and 35:65, respectively, wherein the polyethylene oxide linking unit in the polyethylene oxide terephthalate has a molecular weight of 500; 530; 560; 580; 600; 620; and 650, respectively.

Substantially comparable results are also secured when the sodium linear dodecyl benzene sulfonate in the foregoing composition is replaced by the other detergent materials set forth hereinabove, respectively.

What is claimed is:

1. A detergent composition having improved soil release properties consisting essentially of:

a. from about 2 to about 95% by weight of a member selected from the group consisting of water-soluble anionic, nonionic, zwitterionic and ampholytic surface-active agents and mixtures thereof; and b. from about 0.05 to about 25% by weight of a soil release polymer comprising ethylene terephthalate and polyethylene oxide terephthalate at a molar ratio of ethylene terephthalate to polyethylene oxide terephthalate of from about 25:75 to about 35:65, said polyethylene oxide terephthalate containing polyethylene oxide linking units having a molecular weight of from about 300 to 700, the molecular weight of said soil release polymer being in the range of from about 25,000 to about 55,000.

2. A composition according to claim 1 wherein the surface-active agent is present in an amount from about 5 to about 30% by weight.

3. A composition according to claim 1 wherein the soil release polymer is present in an amount from about 0.2 to about 10% by weight.

4. A composition according to claim 1 wherein the soil release polymer has a molecular weight in the range from about 40,000 to about 55,000.

5. A composition according to claim 1 wherein the surface-active agent is selected from the group consisting of:

i. olefin sulfonates having from about 12 to about 24 carbon atoms;

ii. alkylether sulfates of the general formula $RO(C_2H_4O)_xSO_3M$ wherein R is alkyl or alkenyl of about 10 to avbout 20 carbon atoms, $x$ is an integer from 1 to 30, and M is a water-soluble cation; and iii. alkali metal alkyl benzene sulfonates having from about 9 to about 20 carbon atoms in the alkyl group.

6. A composition according to claim 5 wherein the soil release polymer contains polyethylene oxide linking units having a molecular weight in the range from about 500 to about 650.

7. A composition according to claim 6 wherein the soil release polymer contains ethylene terephthalate and polyethylene oxide terephthalate units in a molar ratio of about 30:70.

8. A detergent composition according to claim 1, consisting essentially of:

a. from about 5 to about 30% by weight of a member selected from the group consisting of water-soluble anionic, nonionic, zwitterionic, and ampholytic surfaceactive agents and mixtures thereof;

b. from about 0.2 to about 10% by weight of a soil release polymer comprising ethylene terephthalate and polyethylene oxide terephthalate at a molar ratio of ethylene terephthalate to polyethylene oxide terephthalate of from about 25:75 to about 35:65, said polyethylene oxide terephthalate containing polyethylene oxide linking units having a molecular weight of from about 300 to about 700, the molecular weight of said soil release polymer being in the range of from about 25,000 to about 55,000; and c. from about 20 to about 70% by weight of a detergency builder.

* * * * *